US005690206A

United States Patent [19]

Carroll, Jr. et al.

[11] Patent Number: 5,690,206

[45] Date of Patent: Nov. 25, 1997

[54] APPLIANCE INTERLOCKING MECHANISM

[76] Inventors: James M. Carroll, Jr., 6 Hunting St., Wellesley, Mass. 02181-3406; Juan J. Barrena, 107 Merino St., Providence, R.I. 02909

[21] Appl. No.: 593,846

[22] Filed: Jan. 30, 1996

[51] Int. Cl.[6] ..... D06F 37/42

[52] U.S. Cl. ..... 192/136; 68/21.26; 200/61.7

[58] Field of Search ..... 192/135, 136; 68/12.26, 23 R; 200/61.62, 61.7

[56] References Cited

U.S. PATENT DOCUMENTS

| | | | |
|---|---|---|---|
| 2,882,360 | 4/1959 | Sisson | 200/61.7 |
| 3,272,935 | 9/1966 | Beller et al. | 200/61.7 |
| 3,440,373 | 4/1969 | Blewitt, Jr. | 200/61.7 |
| 3,504,777 | 4/1970 | Waugh | 192/136 |
| 4,449,383 | 5/1984 | Cartier | 68/12.26 X |
| 5,038,587 | 8/1991 | Harmelink | 68/12.26 |
| 5,050,407 | 9/1991 | Wild | 192/136 X |

*Primary Examiner*—Richard M. Lorence

[57] ABSTRACT

A mechanisms for interlocking access doors of appliances such as clothes washing machines to prevent an operator from introducing his hand into an enclosure while machinery is moving therein includes a striker affixed to the appliance door extending from the door hinge in a direction opposite to that of the door engages a linkage which passes through the enclosure wall and operates an interlock switch mounted on the wall and outside the enclosure. Using the invention the interlock switch may be located in a protected piece outside the enclosure where the washing takes place, and the linkage connecting the access door to the switch may be placed where it is difficult to tamper with.

6 Claims, 3 Drawing Sheets

APPLIANCE INTERLOCKING MECHANISM

BRIEF SUMMARY OF THE INVENTION

This invention relates to mechanisms for interlocking access doors of appliances such as clothes washing machines to prevent an operator from introducing his hand into an enclosure while machinery is moving therein.

A striker affixed to an appliance door extends from the door hinge in a direction opposite to that of the door and when the door is closed engages a linkage which passes through the enclosure wall and operates an interlock switch mounted on the wall and outside the enclosure. Using the invention the interlock switch may be located in a protected place outside the enclosure where the washing takes place, and the linkage connecting the access door to the switch may be placed where it is difficult to tamper with.

DETAILED DESCRIPTION

Figure 1:
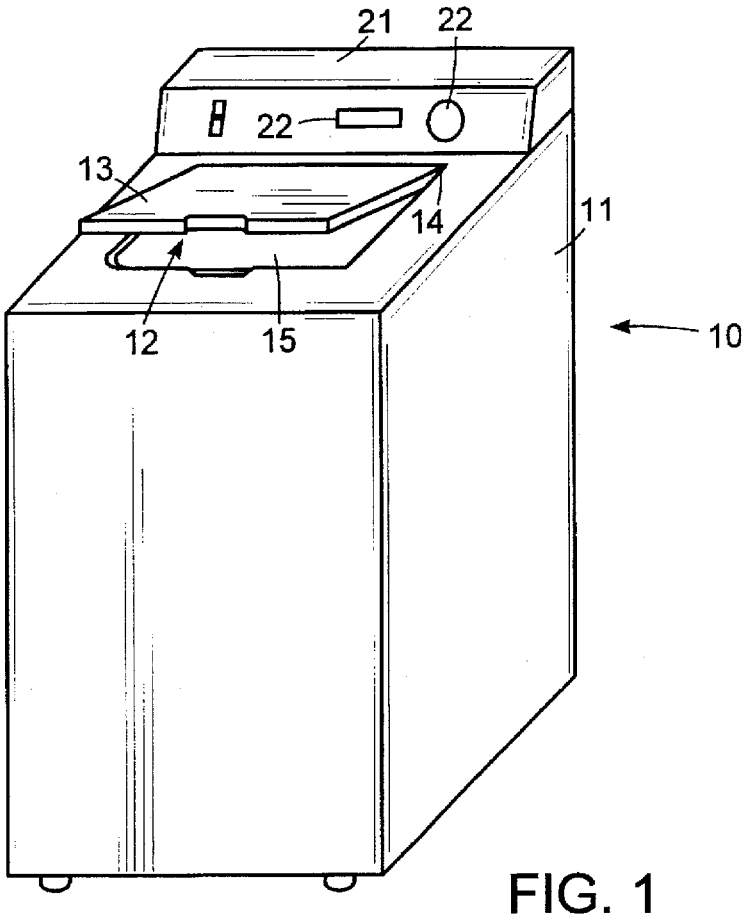
FIG. 1 shows an appliance with an interlock mechanism according to the invention.

With reference to the drawing, particularly FIG. 1, an appliance such as clothes washing machine according to the invention, includes enclosing wall 11 surrounding enclosure 12 and to which is attached access lid 13 swinging on hinge 14. The preponderant part of lid 13 extends on one side of hinge 14, and the lid swings away from enclosure 12 to an open position. When lid 13 is in its open position it gives an operator access to interior portion 15 of enclosure 12, and when it is in its closed position it prevents an operator from inserting a hand into the interior of enclosure 12.

Instrument console cover 21 is attached to enclosing wall 11 to provide an enclosed space 23 outside of enclosure 12 wherein electrical control devices 22 may be mounted.

Figure 2:
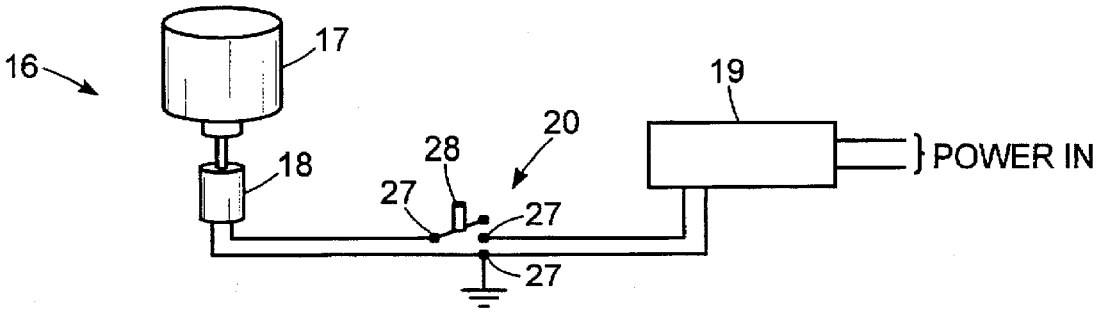
FIG. 2 shows a schematic diagram of the interlock circuitry of the appliance of FIG. 1.
Figure 3:
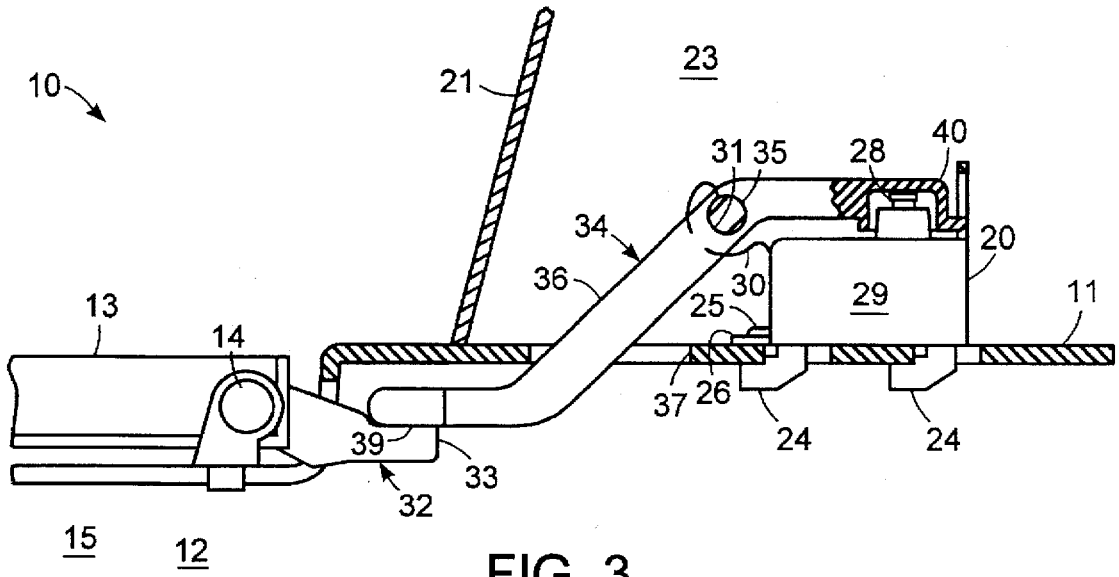
FIG. 3 shows in a vertical section view the linkage between the lid and the interlock switch of the appliance of FIG. 1, the lid being in the closed position.
Figure 4:
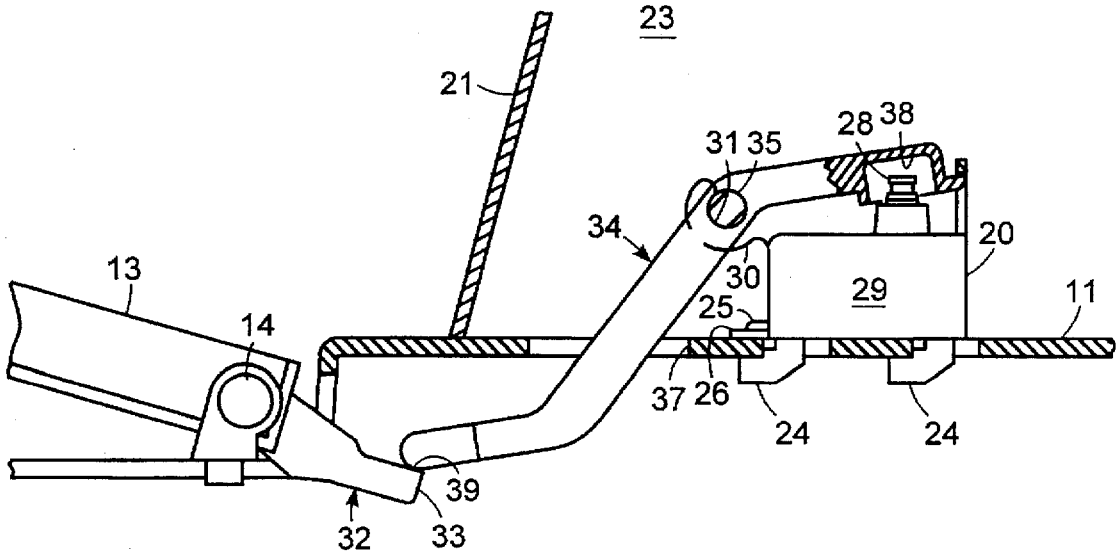
FIG. 4 shows the linkage of FIG. 3, the lid being slightly opened.
Figure 5:
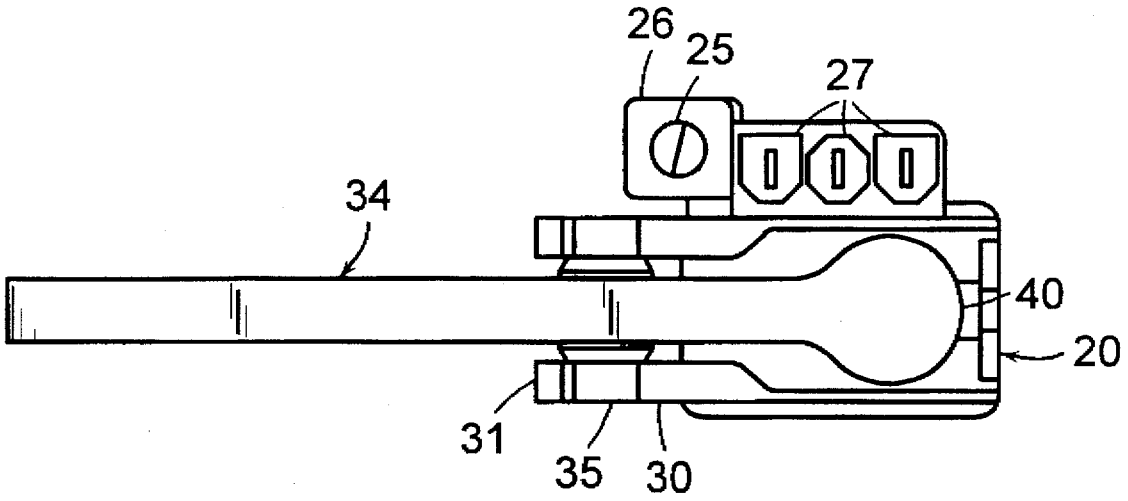
FIG. 5 shows a top view of the linkage and switch of the appliance of FIG. 1.

As shown particularly in FIG. 2, electrically driven moving machinery 16 is situated inside enclosure Machinery 16 includes spin basket 17 driven by electric motor 18. Electric power for motor 18 is provided through control circuitry 19 and electrical interlock switch As shown particularly in FIGS. 3 and 4, interlock switch 20 is situated within enclosed space 23. Housing 29 of switch 20 is secured to wall 11 by hooks 24 and screw 25 securing tab 26 to wall 11. Structural extension 30 of housing 29 supports and terminates in bearing 31. Screw 25 also provides a ground connection for the switch to well 26. Terminals 27 provide connections to electrical circuitry. Actuating button 28 is biassed to its up position by internal springs, and when in its up position puts switch 20 in its OFF position disconnecting power from motor 18. When button 28 is pressed down it puts switch in its ON position connecting power to motor 18.

Striker 32, having a generally rod-like form, is affixed to lid 13 in a position so that it extends from hinge 14 in a direction opposite from that of the preponderance of lid 13 so that distal end 33 of striker 32 swings away from wall 11 as lid 13 opens and swings toward wall 11 as lid 13 closes.

Linking structure 34 includes journal 35 and is supported on wall 11 through journal 35, bearing 31, structural extension 30, and switch housing 29. Shaft 36 of linking structure 34 extends through aperture 37 in wall 11. One end of linking structure 34 is formed into a cap 40 which covers actuating button 28 of switch 20 and provides a bearing portion 38 positioned to engage button 28. At its other end linking structure 34 terminates in bearing portion 39 positioned to engage distal end 33 of striker 32 when lid 13 is closed.

The operation of the appliance is as follows. When lid 13 is closed, preventing an operator from introducing his hand into enclosure 12, the distal end of striker 32 engages and bears on bearing portion 39 of linking structure 34 causing linking structure 34 to rotate on its journal 35 and cause bearing portion 38 to press upon actuating button 38 and move it downward so that switch 20 is put in its ON position. This connects power to motor 18 which moves spin basket 17. When the lid 13 is pivoted up on its hinge, striker 32 rotates with the lid, its distal end 33 moving downwards. The initial downward motion of distal end 33 (typically about 10 deg.) permits linking structure 34 to be rotated by the bias force on button 28; then with further opening of lid 13 striker 32 swings further into enclosure 12 and ceases to make contact with linking structure 34. When button 28 rises it switches switch 20 to its OFF position, disconnecting power from motor 18 and stopping spin basket 17.

Cap 40 covers button 28 and guards against fluids splashing into the switching interior.

It will be recognized by those skilled in the art that the invention is not limited to the embodiment described above but has application generally to apparatus where an interlock switch is used to prevent dangerous access through a swinging door.

We claim:

1. An appliance having electrically driven moving machinery within an enclosure, said enclosure having a wall to which is attached an access lid swinging on a hinge, the preponderant part of said lid extending on one side of said hinge, said lid swinging away from said enclosure to an open position giving an operator access to an interior portion of said enclosure and swinging to a closed position preventing an operator from inserting a hand into said interior portion, said appliance including an electrical interlock switch, said interlock switch being affixed to said wall, said interlock switch having an actuating button and being connected to connect power to said electrically driven moving machinery when said actuating button is in an ON position and to interrupt power to said electrically driven moving machinery when said actuating button is in an OFF position, said appliance including a striker with rod-like form, said striker being affixed to said lid so that it extends from said hinge in a direction away from the preponderant part of said lid and so that a distal end of said striker swings away from said wall into said enclosure as the lid opens and swings toward said wall as the lid closes, said appliance including a rigid linking arm with a journal, said journal being supported on a bearing supported on said wall, said rigid linking arm having a first bearing portion positioned to engage said actuating button and a second bearing portion positioned to engage the distal end of said striker when said lid is closed, said striker and said rigid linking arm being constructed and arranged so that when said lid is closed, the distal end of said striker bears upon the second bearing portion of the rigid linking arm and the first bearing portion of the rigid linking arm bears on the actuating button of said interlock switch to put it in said ON position.

2. An appliance as claimed in claim 1, said switch including a housing affixed to said wall, said housing having a structural extension terminating in said bearing, said bearing thereby being supported on said wall through said housing.

3. An appliance as claimed in claim 1, said switch being mounted within a housing with said actuating button protruding upwards through an aperture in the housing, an inverted cup being affixed to said linking arm and covering said actuating button and said housing aperture to guard against entry of splashed fluids into said housing.

4. An appliance as claimed in claim 1, said appliance having a control console attached to said wall enclosing a space outside said wall, and said interlock switch being positioned within said space, said switch being grounded to said wall by a screw which also secures the switch to the wall.

5. An appliance having electrically driven moving machinery within an enclosure, said enclosure having a wall to which is attached a lid swinging on a hinge, the preponderant part of said lid extending to one side of said hinge, said lid swinging away from said enclosure to an open position giving an operator access to an interior portion of said enclosure and swinging to a closed position preventing an operator from inserting a hand into said interior portion, said appliance including an electrical interlock switch, said interlock switch being affixed to said wall, said interlock switch having an actuating button and being connected to connect power to said electrically driven moving machinery when said actuating button is in an ON position and to interrupt power to said electrically driven moving machinery when said actuating button is in an OFF position, said appliance including a striker with rod-like form, said striker being affixed to said lid so that it extends from said hinge in a direction away from the preponderant part of said lid and so that a distal end of said striker swings away from said wall into said enclosure as the lid opens and swings toward said wall as the lid closes, said striker distal end having a bearing region which as said lid closes makes contact with and bears on structure to put said interlock switch in said ON position and when said lid is open has no contact with said structure.

6. An interlock mechanism for interrupting electrical power to electrically driven machinery in an enclosure within a wall, access to said machinery being provided by an access lid swinging on a hinge attached to said wall and giving access to said electrically driven machinery when swung to an open position away from said wall and blocking access to said electrically driven machinery when swung to a closed position toward said wall, the preponderant part of said lid extending to one side of said hinge, said lid having affixed thereto a striker having rod-like form and extending from said hinge in a direction away from the preponderant part of said lid so that a distal end of said striker swings away from said wall as the lid opens and swings toward said wall as the lid closes, said interlock mechanism comprising a housing supporting and enclosing an electrical switch, a housing extension affixed to said housing supporting a bearing, and a rigid linking arm, said housing including means for attaching said housing to said wall in a predetermined position, said electrical switch having an actuating button and electrical terminals, said rigid linking arm having a journal supported on said bearing and a first bearing portion at a first end engaging said actuating button, said linking arm having a second bearing portion at a second end and being shaped so that when said housing is attached to said wall in said predetermined position said second bearing portion is positioned to be engaged by said striker when said lid is closed, said interlock mechanism being effective when installed in said predetermined position and when power for operation of said electrically driven machinery is routed through said switch to permit operation of said electrical machinery when said lid is closed and to interrupt operation of said electrical machinery when said lid is opened.

* * * * *

UNITED STATES PATENT AND TRADEMARK OFFICE

CERTIFICATE OF CORRECTION

PATENT NO. : 5,690,206
DATED : Nov. 25, 1997
INVENTOR(S) : Carroll et al.

It is certified that error appears in the above-identified patent and that said Letters Patent is hereby corrected as shown below:

On the title page, item [57]

In abstract, line 10:

"piece" should be --place--

At col 1, line 49:

after "enclosure" insert --12.--

At col 1, line 52:

after "switch' insert --20.--

At col 1, line 58:

"well" should be --wall--

At col 2, line 31:

"switching" should be --switch--

Signed and Sealed this

Seventeenth Day of February, 1998

Bruce Lehman

*Attest:*

BRUCE LEHMAN

*Attesting Officer*

*Commissioner of Patents and Trademarks*